US007398206B2

(12) United States Patent
Morii et al.

(10) Patent No.: US 7,398,206 B2
(45) Date of Patent: Jul. 8, 2008

(54) SPEECH CODING APPARATUS AND SPEECH DECODING APPARATUS

(75) Inventors: Toshiyuki Morii, Kanagawa (JP); Kazutoshi Yasunaga, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 48 days.

(21) Appl. No.: 11/429,944

(22) Filed: May 9, 2006

(65) Prior Publication Data

US 2006/0206317 A1 Sep. 14, 2006

Related U.S. Application Data

(63) Continuation of application No. 09/462,493, filed as application No. PCT/JP99/03064 on Jan. 21, 2000, now Pat. No. 7,110,943.

(30) Foreign Application Priority Data

Jun. 9, 1998 (JP) ..... 10-160119
Sep. 11, 1998 (JP) ..... 10-258271

(51) Int. Cl.
*G10L 19/12* (2006.01)

(52) U.S. Cl. ..... 704/223

(58) Field of Classification Search ..... None
See application file for complete search history.

(56) References Cited

U.S. PATENT DOCUMENTS 5,060,269 A 10/1991 Zinser
5,737,484 A 4/1998 Ozawa
5,963,896 A * 10/1999 Ozawa ..... 704/219
5,991,717 A * 11/1999 Minde et al. ..... 704/223
7,110,943 B1 * 9/2006 Morii et al. ..... 704/223

FOREIGN PATENT DOCUMENTS

| | | |
|---|---|---|
| JP | 5-165497 | 7/1993 |
| JP | 5-232994 | 9/1993 |
| JP | 6-222797 | 8/1994 |
| WO | 91/13432 | 9/1991 |
| WO | 95/16260 | 6/1995 |

OTHER PUBLICATIONS

"Code Excited Linear Prediction (CELP): High-Quality Speech At Very Low Bit Rates", M.R. Schroeder, ICASSP'85, Proceedings, pp. 937-940 (1985).

"Adaptive Density Pulse Excitation for Low Bit Rate Speech Coding", M. Akamine et al., IEICE Trans. on Fundamentals of Electronics, Communications and Computer Sciences, vol. E78-A, No. 2 (1995).

(Continued)

*Primary Examiner*—Angela A Armstrong
(74) *Attorney, Agent, or Firm*—Greenblum & Bernstein, P.L.C.

(57) ABSTRACT

First codebook and second codebook respectively have two subcodebooks, and in respective codebooks, addition sections obtain respective excitation vectors by adding sub-excitation vectors fetched from respective two subcodebooks. Addition section obtains an excitation sample by adding those excitation vectors. According to the aforementioned constitution, it is possible to store sub-excitation vectors with different characteristics in respective sub-codebooks. Therefore, it is possible to correspond to input signals with various characteristics, and achieve excellent sound qualities at the time of decoding.

16 Claims, 12 Drawing Sheets

OTHER PUBLICATIONS

"CELP Coding With An Adaptive Density Pulse Excitation Model", M. Akamine et al., ICASSP'90, Speech and Processing 1, pp. 29-32, (Apr. 3, 1990).
English Language Abstract of JP 6-222797.
English Language Translation of the Notice of Reason for Rejection.
Notice of Reason for Rejection in Japanese.
English Language Abstract of JP 5-232994.
English Language Abstract of JP 5-165497.
English Language Abstract of JP 6-222797.

* cited by examiner

91a SUBCODEBOOK
j

92a SUBCODEBOOK
m
n

IN THE CASE OF j+m

91b SUBCODEBOOK
j

92b SUBCODEBOOK
m
n

IN THE CASE OF j+n

SPEECH CODING APPARATUS AND SPEECH DECODING APPARATUS

This is a continuation of U.S. patent application Ser. No. 09/462,493, filed Jan. 21, 2000, now U.S. Pat. No. 7,110,943 which is a U.S. National Stage Application of PCT/JP1999/03064, filed on Jun. 8, 1999, which was published in English, the contents of which are expressly incorporated by reference herein in its entirety.

The present invention relates to a speech coding apparatus and a speech decoding apparatus using speech coding algorithm at low bit rates used in digital communications such as a portable telephone.

BACKGROUND ART

Speech compression coding methods at low bit rates have been required in order to accept an increase of subscribers in digital mobile communications such as a portable telephone, and the researches and developments have been proceeded by many research institutions. In Japan, applied coding systems as a standard system in portable telephones are VSELP at a bit rate of 11.2 kbps developed by Motorola and PSI-CELP at a bit rate of 5.6 kbps developed by NTT Mobile Communications Network. INC., and portable telephones with these system are produced In addition, internationally, the ITU-T selected CS-ACELP, which was co-developed by Nippon Telegraph and Telephone Corporation and France Telecom, as an international standard speech coding system G.729 at 8 kbps. The system is scheduled to be used in Japan as speech coding system for portable telephones.

The above-described systems are all achieved by modifying the CELP system (Code Excited Linear Prediction: M. R. Schroeder "High Quality Speech at Low Bit Rates" described in Proc. ICASSP '85 pp. 937-940). A feature of this system is to apply a method of dividing a speech into excitation information and vocal truct information, code the excitation information with indices of a plurality of excitation samples stored in a codebook, while coding the LPC (Linear Prediction Coefficients) with respect to the vocal truct information, and perform a comparison to an input speech considering of the vocal truct information in the excitation information coding (A-b-S: Analysis by Synthesis).

The basic algorithm of the CELP system will be described using FIG. 1. FIG. 1 is a block diagram illustrating a configuration of a speech coding apparatus in the CELP system. In the speech coding apparatus illustrated in FIG. 1, LPC analyzing section 2 executes autocorrelation analysis and LPC analysis on input speech data 1 to obtain the LPC. LPC analyzing section 2 further codes the obtained LPC to obtain the coded LPC. LPC analyzing section 2 furthermore decodes the obtained coded LPC to obtain the decoded LPC.

Excitation generating section 5 fetches excitation samples stored in adaptive codebook 3 and stochastic codebook 4 (respectively referred to as an adaptive code vector (or adaptive excitation) and stochastic code vector (or stochastic excitation)) and provides respective excitation samples to LPC synthesis section 6. LPC synthesis section 6 executes filtering on two excitations obtained at excitation generating section 5 with the decoded LPC obtained at LPC analyzing section 2.

Comparing section 7 analyzes the relation of two synthesized speeches obtained at LPC synthesis section 6 and the input speech, obtains an optimal value (optimal gain) for two synthesized speeches, adds each synthesized speech respectively subjected to power adjustment with the optimal gain to obtain a total synthesized speech, and executes a distance calculation between the total synthesized speech and the input speech. Comparing section 7 further executes, with respect to all excitation samples in adaptive codebook 3 and stochastic codebook 4, the distance calculations between the input speech and each of other many synthesized speeches obtained by functioning excitation generating section 5 and LPC synthesis section 6, and obtains an index of the excitation sample whose distance is the smallest among the obtained distances. Then, comparing section 7 provides the obtained optimal gain, indices of excitation samples of respective codebooks and two excitation samples corresponding to respective index to parameter coding section 8.

Parameter coding section 8 executes coding on the optimal gain to obtain the coded gain and provides the coded gain, the coded LPC and the indices of excitation samples to transmission path 9. Further, parameter coding section 8 generates an actual excitation signal (synthesized excitation) using the coded gain and two excitations corresponding to the respective index and stores the excitation signal in adaptive codebook 3 while deleting old excitation samples.

In addition, it is general for the synthesis at LPC synthesis section 6 to use together Linear Prediction Coefficients and a high-frequency enhancement filter or a perceptual weighting filter with long-term prediction coefficients (which are obtained by the long-term prediction analysis of input speech). It is further general to execute the excitation search on the adaptive codebook and stochastic codebook at an interval (called subframe) obtained by further dividing an analysis interval.

The stochastic codebook will be described next.

The adaptive codebook is a codebook for an effective compression using a long-term correlation existing at intervals of human vocal cord vibrations, and stores previous synthesized excitations. On the contrary, the stochastic code book is a fixed codebook to reflect statistical characteristics of excitation signals. As excitation samples stored in the stochastic codebook, there are, for example, random number sequence, pulse sequence, random number sequence/pulse sequence obtained by statistic training with speech data, or pulse sequence with relatively small number of pulses generated algebraically (algebraic codebook). The algebraic codebook has been especially paid attention recently and known by that a good sound quality is obtained at bit rates such as 8 kbps with small calculation amounts.

However, an application of algebraic codebook with a small number of pulses to coding at lower bit rates introduces a phenomenon that sound qualities greatly deteriorate mainly on unvoiced consonants and background noises. On the other hand, an application of excitation with a large number of pulses such as random number sequence to coding at lower bit rates introduces a phenomenon that sound qualities greatly deteriorate mainly on voiced speeches. In order to improve the deterioration, a method with multi-codebook, in which a voiced/unvoiced judgement is performed, is examined. However, the method has the complicated processing and sometimes generates an allophone caused by a judgement error on a speech signal.

As described above, there has been no algebraic codebook which matches any effective coding on voiced speeches, unvoiced speeches and background noises. Therefore, it has been required to obtain a speech coding apparatus and a speech decoding apparatus capable of effectively coding any of voiced speeches, unvoiced speeches and background noises.

DISCLOSURE OF INVENTION

An object of the present invention is to provide a speech coding apparatus and a speech decoding apparatus capable of effectively coding any of voiced speeches, unvoiced speeches and background noises and obtaining speeches with excellent qualities with a small amount of information and a small amount of computations.

The inventors of the present invention noticed that pulse positions are relatively near at a voiced sound segment of speech, while pulse positions are relatively far at segments of unvoiced sound of speech and background noise, in the case of applying a pulse sequence to coding at low bit rates. In other words, the inventors noticed that energy-concentrated excitation samples, which are characteristics of human vocal cord wave, are needed in a voiced speech, and in this case, there is a tendency that a small number of pulses whose positions are near are selected, while an excitation having more random number characteristics is needed in a unvoiced speech and background noise, in this case, there is a tendency that a large number of energy-spread pulses are selected.

Based on the foregoing consideration, the inventors found out that the perception is improved by identifying a speech as voiced sound segment, or unvoiced sound segment and background noise segment by recognizing a distance of pulse positions, and based on the identification result, applying respective pulse sequences appropriate for the voiced sound segment, and the unvoiced and background noise segments, to achieve the present invention.

A feature of the present invention, is to use a plurality of codebooks each having two subcodebook of which characteristics are different and add excitation vectors of each subcodebook to obtain excitation vectors. According to the algorithm, the characteristics as a small-number-pulse excitation appear in the case where pulse positions are near, which is caused by the relationships of positions of the excitation vectors with a small number of pulses, while the characteristics as a large-number-pulse excitation appear in the case where pulse positions are far, which is suited to the characteristics of speech signals containing background noises.

Accordingly, without using particular voiced/unvoiced speech judgement algorithm, it is possible to automatically select an excitation most suitable for the localized characteristics in input signals, effectively code any of voiced speeches, unvoiced speeches and background noises, and obtain synthesized speeches with excellent sound qualities with a small amount of information and a small amount of computations.

BEST MODE FOR CARRYING OUT THE INVENTION

Embodiments of the present invention will be described in detail with reference to accompanying drawings.

First Embodiment

Figure 1:
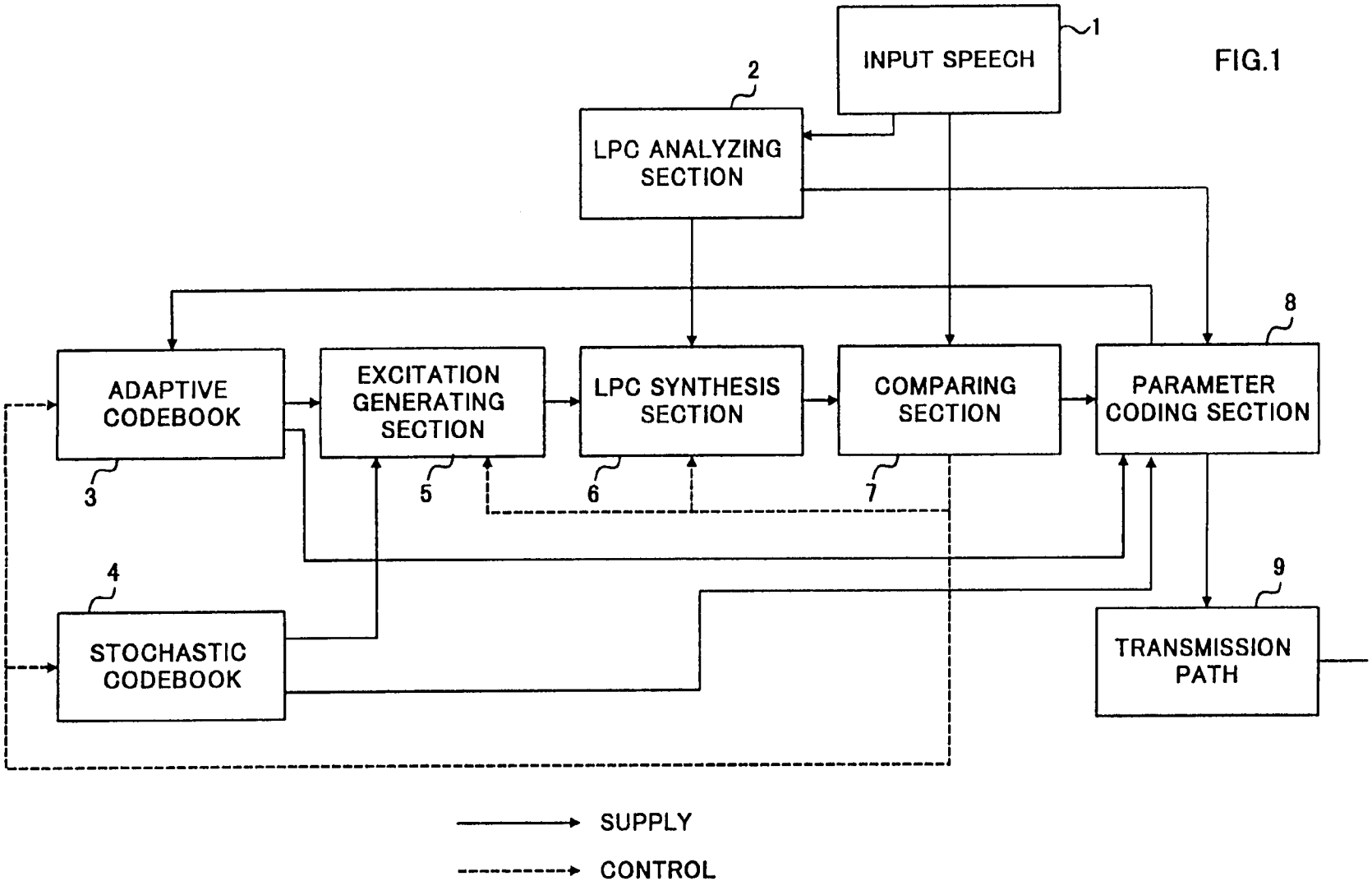
FIG. 1 is a block diagram illustrating a configuration of a speech coding apparatus in a conventional CELP system.
Figure 2:
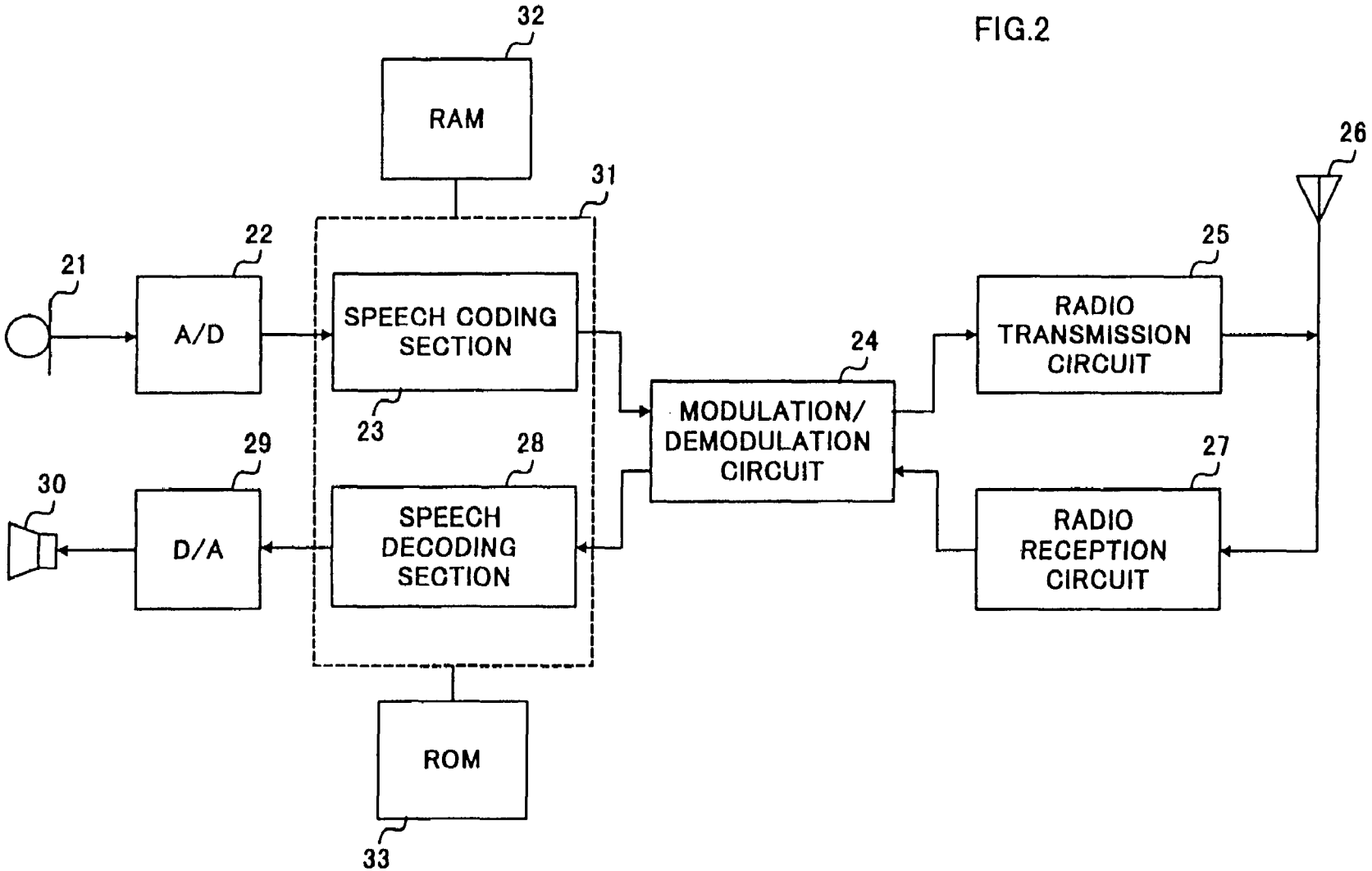
FIG. 2 is a block diagram illustrating a configuration of a radio communication apparatus having a speech coding apparatus and a speech decoding apparatus of the present invention.

FIG. 2 is a block diagram illustrating a configuration of a radio communication apparatus having a speech coding/decoding apparatus according to the first embodiment to the third embodiment of the present invention.

In this radio communication apparatus, at a transmitting side, a speech is converted into electric analogue signals at speech input device 21 such as a microphone and output to A/D converter 22. The analogue speech signals are converted into digital speech signals at A/D converter 22 and output to speech coding section 23. Speech coding section 23 executes speech coding processing on the digital speech signals and outputs the coded data to modulation/demodulation circuit 24. Modulation/demodulation circuit 24 executes digital modulation on the coded speech signals to output to radio transmission circuit 25. Radio transmission circuit 25 executes the predetermined radio transmission processing on the modulated signals. The signals are transmitted via antenna 26. In addition, processor 31 executes the processing properly using data stored in RAM 32 and ROM 33.

On the other hand, at a receiving side in the radio communication apparatus, received signals received at antenna 26 are subjected to the predetermined radio reception processing at radio reception circuit 27 and output to modulation/demodulation circuit 24. Modulation/demodulation circuit 24 executes demodulation processing on the received signals and outputs the demodulated signals to speech decoding section 28. Speech decoding section 28 executes decoding processing on the demodulated signals to obtain digital decoded speech signals and output the digital decoded speech signals to D/A converter 29. D/A converter 29 converts the digital decoded speech signals output from speech decoding section 28 into analogue decoded speech signals to output to speech output device 30 such as a speaker. Finally, speech output device 30 converts electric analogue decoded speech signals into decoded speech to output.

Speech coding section 23 and speech decoding section 28 are operated by processor 31 such as DSP using codebooks stored in RAM 32 and ROM 33. The operation program is also stored in ROM 33.

Figure 3:
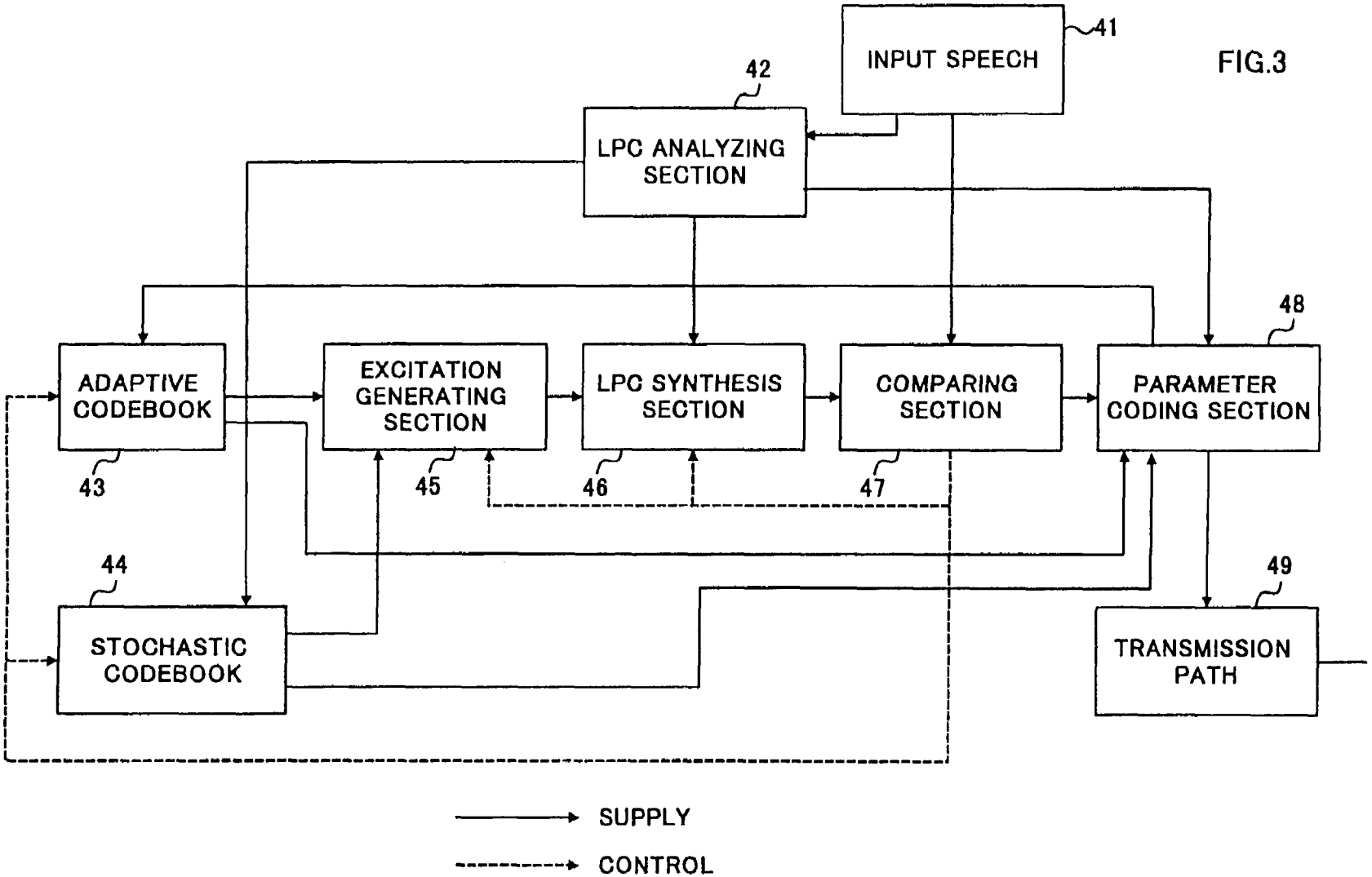
FIG. 3 is a block diagram illustrating a configuration of a speech coding apparatus in a CELP system according to a first embodiment to a third embodiment of the present invention.

FIG. 3 is a block diagram illustrating a configuration of a speech coding apparatus in the CELP system according to the first embodiment to the third embodiment of the present invention. The speech coding apparatus is included in speech coding section 23 illustrated in FIG. 2. In addition, adaptive codebook 43 illustrated in FIG. 3 is stored in RAM 32 illustrated in FIG. 2, and stochastic codebook 44 illustrated in FIG. 3 is stored in ROM 33 illustrated in FIG. 2.

In the speech coding apparatus (hereinafter, also referred to as coder) illustrated in FIG. 3, LPC analyzing section 42 executes autocorrelation analysis and LPC analysis on input speech data 41 to obtain the LPC. LPC analyzing section 42 further codes the obtained LPC to obtain the LPC code. LPC analyzing section 42 furthermore decodes the obtained LPC code to obtain the decoded LPC. In the coding, it is generally executed to convert into parameters having good interoperation characteristics such as LSP (Linear Spectrum Pair) then code by VQ (Vector Quantization).

Excitation generating section 45 fetches excitation samples stored in adaptive codebook 43 and stochastic codebook 44 (respectively referred to as adaptive code vector (or adaptive excitation) and stochastic code vector (or stochastic excitation)) and provides respective excitation samples to LPC synthesis section 46. The adaptive codebook is a codebook in which excitation signals previously synthesized are stored and an index represents which synthesized excitation is used among from excitations synthesized at different previous times, i.e., time lag.

LPC synthesis section 46 executes filtering on two excitations obtained at excitation generating section 45 with the decoded LPC obtained at LPC analyzing section 42

Comparing section 47 analyzes the relation of two synthesized speeches obtained at LPC synthesis section 46 and the input speech, obtains an optimal value (optimal gain) for two synthesized speeches, adds each synthesized speech respectively subjected to power adjustment with the optimal gain to obtain a total synthesized speech, and executes a distance calculation between the total synthesized speech and the input speech. Comparing section 47 further executes, with respect to all excitation samples in adaptive codebook 43 and stochastic codebook 44, the distance calculations between the input speech and each of other many synthesized speeches obtained by functioning excitation generating section 45 and LPC analyzing section 46, and obtains an index of the excitation sample whose distance is the smallest among the obtained distances. Then, comparing section 47 provides the obtained optimal gain, indices of excitation samples of respective codebooks and two excitation samples corresponding to respective index to parameter coding section 48.

Parameter coding section 48 executes coding on the optimal gain to obtain the gain code and provides the gain code, the LPC code and the indices of excitation samples to transmission path 49. Further, parameter coding section 48 generates an actual excitation signal (synthesized excitation) using the gain code and two excitations corresponding to the index and stores the excitation signal in adaptive codebook 43 while deleting old excitation samples.

In addition, it is general for the synthesis at LPC synthesis section 46 to use together Linear Prediction Coefficients and a high-frequency enhancement filter or a perceptual weighting filter with long-term prediction coefficients (which are obtained by the long-term prediction analysis of input speech). It is further general to execute the excitation search on the adaptive codebook and stochastic codebook at an interval (called subframe) obtained by further dividing an analysis interval.

Figure 4:
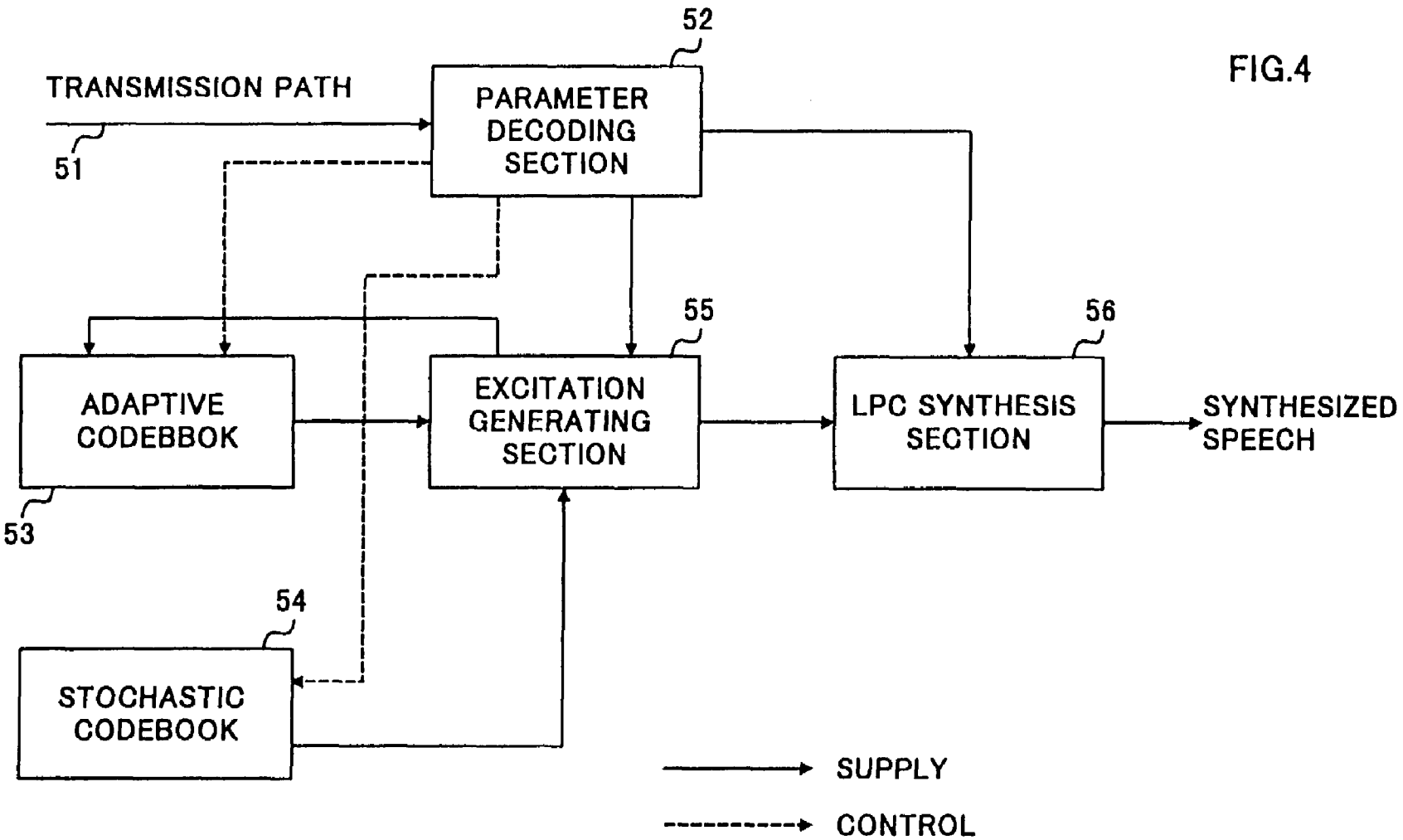
FIG. 4 is a block diagram illustrating a configuration of a speech decoding apparatus in the CELP system according to a first embodiment to a third embodiment of the present invention.

FIG. 4 is a block diagram illustrating a configuration of a speech decoding apparatus in the CELP system according to the first embodiment to the third embodiment of the present invention. The speech decoding apparatus is included in speech decoding section 28 illustrated in FIG. 2. In addition, adaptive codebook 53 illustrated in FIG. 4 is stored in RAM 32 illustrated in FIG. 2, and stochastic codebook 54 illustrated in FIG. 4 is stored in ROM 33 illustrated in FIG. 2.

In the speech decoding apparatus illustrated in FIG. 4, parameter decoding section 52 obtains coded speech signals from transmission path 51, while obtains respective coded excitation samples of excitation codebooks (adaptive codebook 53 and stochastic codebook 54), the coded LPC and coded gain Parameter decoding section 52 then obtains the decoded LPC using the coded LPC and the decoded gain using the coded gain.

Excitation generating section 55 multiplies each excitation sample respectively by the decoded gain to obtain decoded excitation signals. At this stage, excitation generating section 55 stores the obtained decoded excitation signals in adaptive codebook 53 as excitation samples, while deletes old excitation samples. LPC synthesis section 56 executes filtering on the decoded excitation signals with the decoded LPC to obtain a synthesized speech.

In addition, these two excitation codebooks are the same as those included in the speech coding apparatus illustrated in FIG. 3 (reference numerals 43 and 44 in FIG. 3). Sample numbers to fetch excitation samples (codes to adaptive codebook and codes to stochastic codebook) are both supplied from parameter decoding section 52 (which corresponds to the short dashes line in FIG. 5 (control from comparing section 47) described later).

Figure 5:
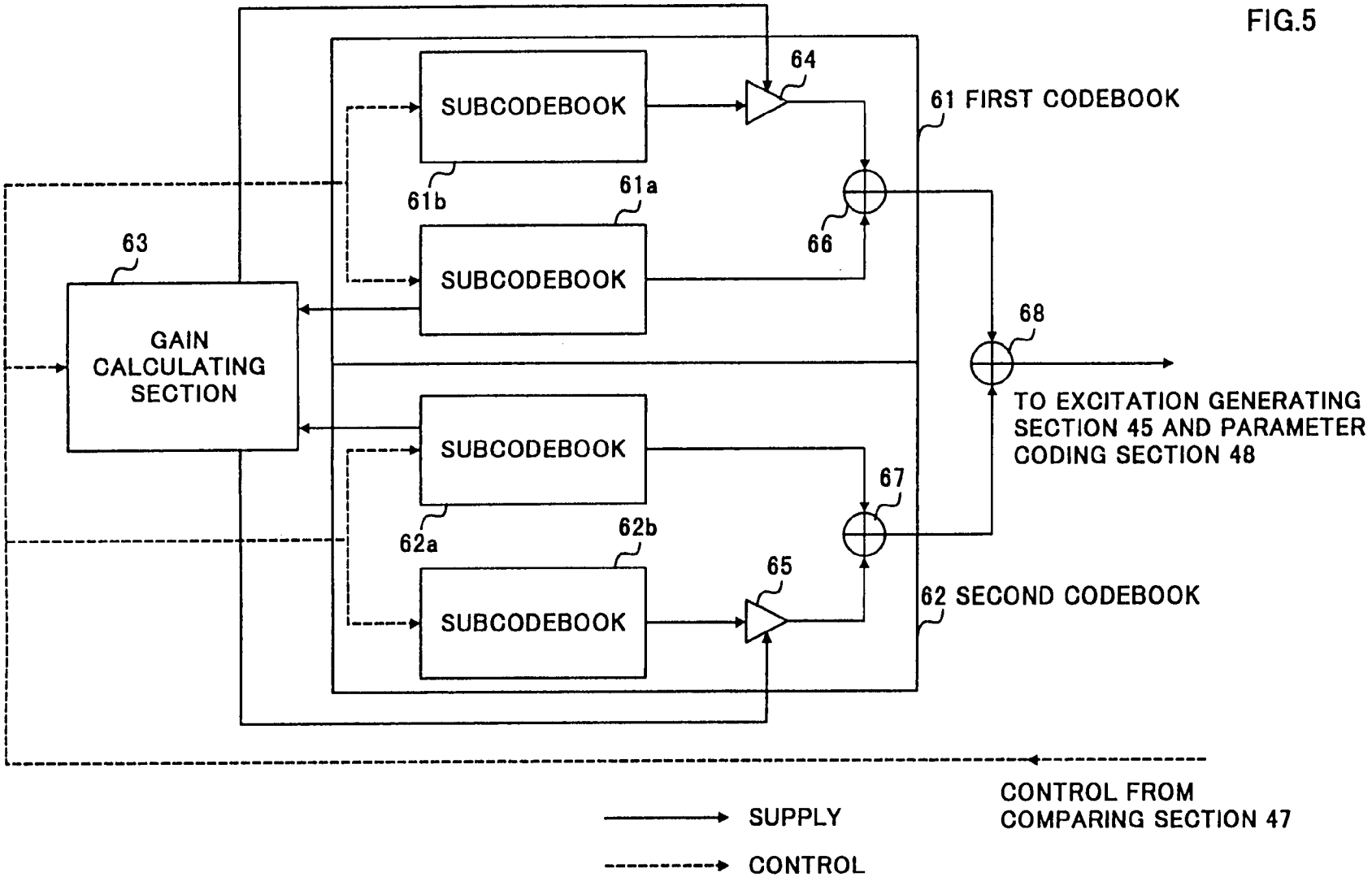
FIG. 5 is a block diagram illustrating a stochastic codebook in a speech coding apparatus/speech decoding apparatus according to the first embodiment of the present invention.

The following description is given to explain in detail about functions of stochastic codebooks 44 and 54 for storing excitation samples, in the speech coding apparatus and speech decoding apparatus with the above configurations, using FIG. 5 FIG. 5 is a block diagram illustrating a stochastic codebook in the speech coding apparatus and speech decoding apparatus according to the first embodiment of the present invention.

The stochastic codebook has first codebook 61 and second codebook 62, and first codebook 61 and second codebook 62 respectively have two subcodebooks 61*a*, 61*b* and 62*a*, 62*b*. The stochastic codebook further has gain calculating section 63 which calculates a gain for outputs from subcodebooks 61*b* and 62*b* using pulse positions in subcodebooks 61*a* and 62*a*.

Subcodebooks 61*a* and 62*a* are mainly used in the case where a speech is a voiced sound (pulse positions are relatively near), and formed by storing a plurality of sub-excitation vectors composed of a single pulse. Subcodebook 61*b* and 62*b* are mainly used in the case where a speech is an unvoiced sound or background noise (pulse positions are relatively far), and formed by storing a plurality of sub-excitation vectors composed of a sequence with a plurality of pulses in which power is spread. The excitation samples are generated in the stochastic codebooks formed as described above. In addition, the near and far pulse positions will be described later.

In addition, subcodebooks 61*a* and 62*b* are formed by a method of arranging pulses algebraically, and subcodebooks 61*b* and 62*b* are formed by another method of dividing a vector length (subframe length) into some segment intervals and making a configuration so that a single pulse is always present at every segment interval (pulses are spread over a whole length).

These codebooks are formed in advance. In this embodiment, as illustrated in FIG. 5, the number of codebooks is set at two and each codebook has two subcodebooks.

Figure 6A:
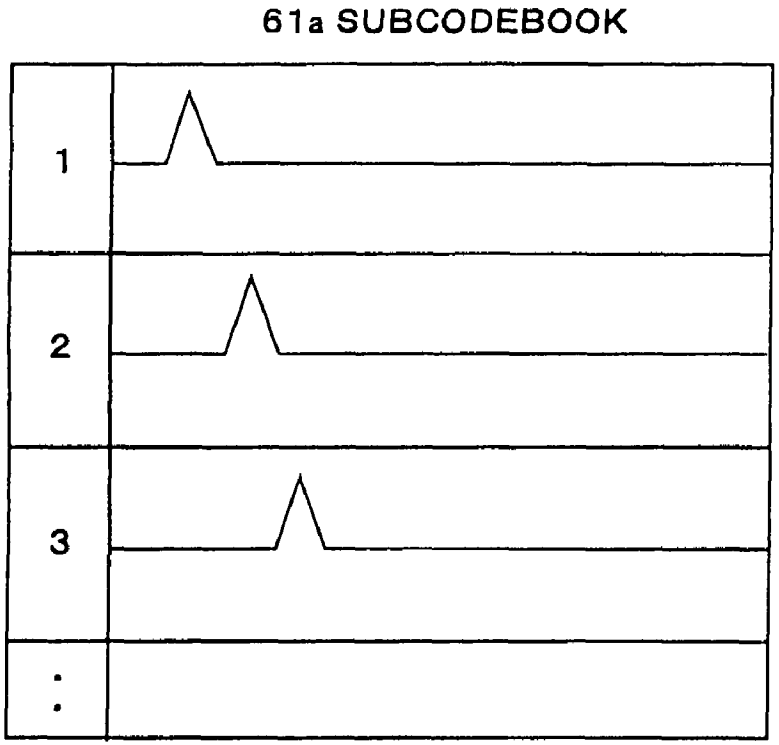
FIG. 6A and FIG. 6B are concept diagrams of sub-excitation vectors stored in subcodebooks in the stochastic codebook.
Figure 6B:
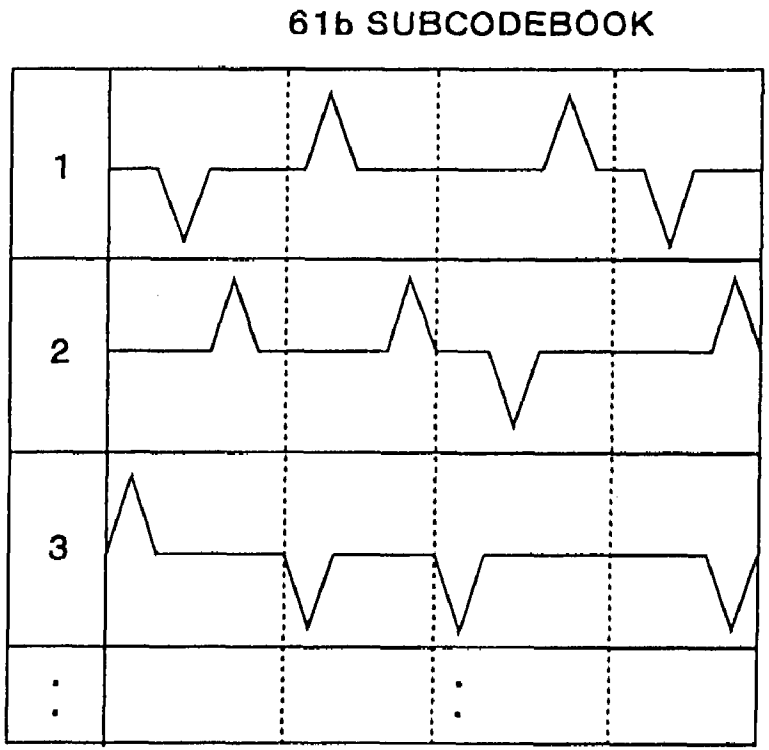

FIG. 6A illustrates sub-excitation vectors stored in subcodebook 61*a* of first codebook 61. FIG. 6B illustrates sub-excitation vectors stored in subcodebook 61*b* of first codebook 61. Similarly, subcodebooks 62*a* and 62*b* of second codebook 62 respectively have sub-excitation vectors illustrated in FIG. 6A and FIG. 6B.

In addition, positions and polarities of pluses of sub-excitation vectors in subcodebooks 61*b* and 62*b* are formed using random numbers. According to the configuration described above, it is possible to form sub-excitation vectors in which power is uniformly spread over a whole vector length even though some fluctuations are present. FIG. 6B illustrates an example in the case where the number of segment intervals is four. In addition, in these two subcodebooks, respective sub-excitation vectors of the same index (number) are used at the same time.

The next description is given to explain speech coding using the stochastic codebooks with the above-mentioned configuration.

Gain calculating section 63 calculates an excitation vector number (index) according to the code from comparing section 47 in the speech coding apparatus. The code provided from comparing section 47 corresponds to the excitation vector number, and therefore the excitation vector number is determined by the code. Gain calculating section 63 fetches sub-excitation vectors with a small number of pulses corresponding to the determined excitation vector number from subcodebooks 61*a* and 62*a*. Gain calculating section 63 further calculates an addition gain using pulse positions of the fetched sub-excitation vectors. The addition gain calculation is given by the following equation (1);

$$g=|P1-P2|/L \qquad \text{equation (1)}$$

where g is an addition gain, P1 and P2 are respectively pulse positions in codebooks 61*a* and 62*a*, and L is a vector, length (subframe length). Further, | | represents an absolute value.

According to the above equation (1), the addition gain is smaller as the pulse positions are nearer (the pulse distance is shorter), while larger as pulse positions are further, and has a lower limit of 0 and an upper limit of 1. Accordingly, as the pulse positions are nearer, the gain for subcodebooks 61*b* and 62*b* is relatively smaller. As a result, an affect of subcodebooks 61*a* and 62*b* corresponding to voiced speech is larger. On the other hand, as the pulse positions are further (the pulse distance is longer), the gain for subcodebooks 61*b* and 62*b* is relatively larger. As a result, an affect of subcodebooks 61*b* and 62*b* corresponding to unvoiced speech and background noise is relatively larger. Perceptually fine sounds are obtained by performing the gain control described above.

Next, gain calculating section 63 refers to the number of excitation vector provided from comparing section 47 and obtains two sub-excitation vectors from subcodebooks, 61*b* and 62*b* with a large number of pulses. These two sub-excitation vectors from subcodebooks 61*b* and 62*b* are respectively provided to gain calculating sections 64 and 65 to be multiplied by the addition gain obtained at gain calculating section 63.

Further, excitation vector addition section 66 obtains a sub-excitation vector from subcodebook 61*a* with a small number of pulses by referring to the number of excitation vector provided from comparing section 47, and also obtains the sub-excitation vector, from subcodebook 61*b*, multiplied by the addition gain obtained at gain calculating section 63. Excitation vector addition section 66 then adds the obtained sub-excitation vectors to obtain an excitation vector. Similarly, excitation vector addition section 67 obtains a sub-excitation vector from subcodebook 62*a* with a small number of pulses by referring to the number of excitation vector provided from comparing section 47, and also obtains the sub-excitation vector, from subcodebook 62*b*, multiplied by the addition gain obtained at gain calculating section 63. Excitation vector addition section 67 then adds the obtained sub-excitation vectors to obtain an excitation vector.

The excitation vectors respectively obtained by adding the sub-excitation vector are provided to excitation vector addition section 68 to be added. According to the foregoing processing, an excitation sample (stochastic code vector) is obtained. The excitation sample is provided to excitation generating section 45 and parameter coding section 48.

On the other hand, a decoding side prepares the same adaptive codebook and stochastic codebook as those in the coder in advance, and based on respective index, LPC code, and gain code of each codebook transmitted from the transmission path, multiplies respective excitation sample by the gain to add. Then the decoding side executes filtering on the added sample with the decoded LPC to decode the speech.

An example of excitation samples selected by the above-mentioned algorithm will be described next using FIG. 7A to FIG. 7F. Assume that an index of first codebook 61 is j, and an index of second codebook 62 is m or n.

Figures 7A, 7B, 7C, 7D, 7E, 7F:
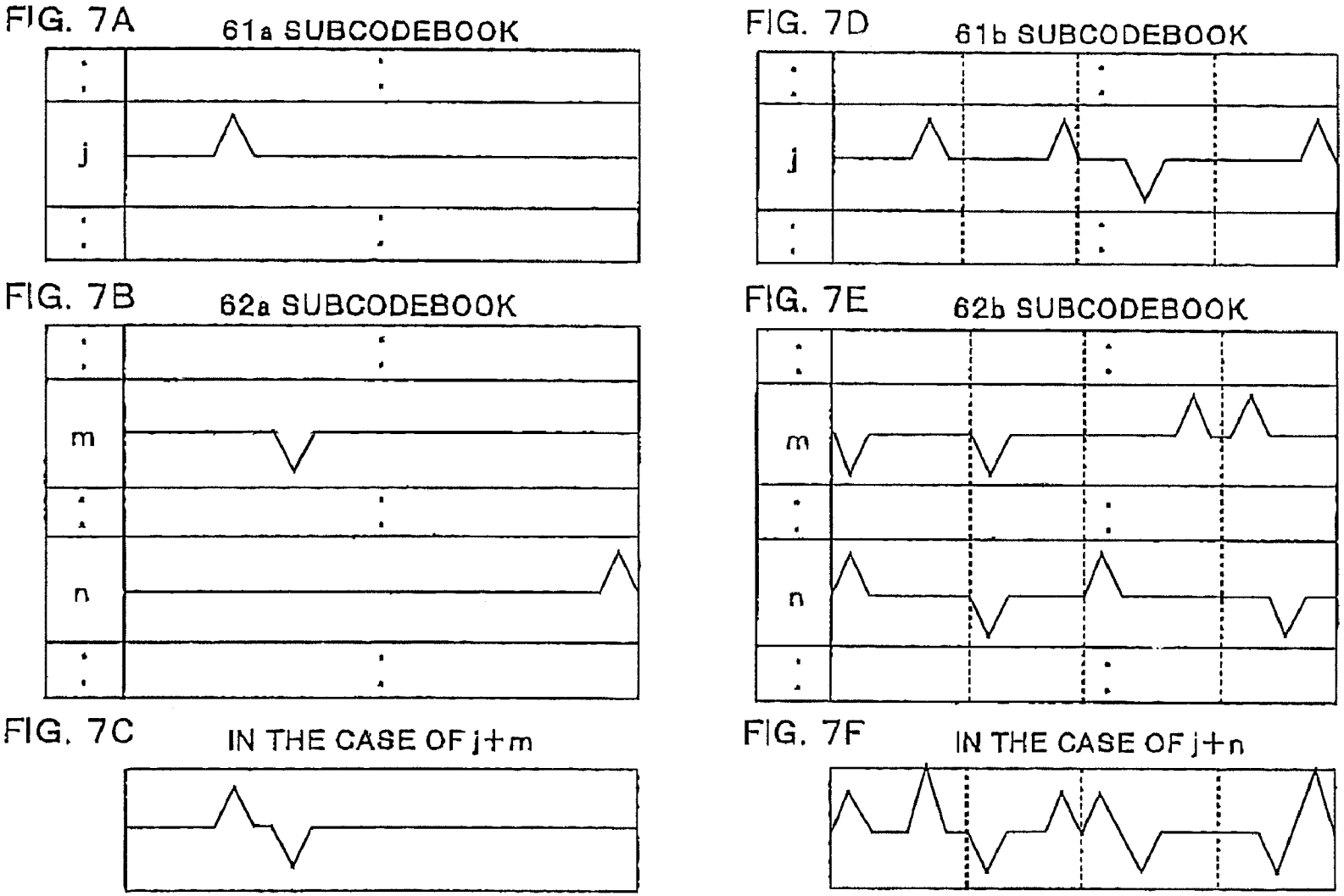
FIGS. 7A to 7F are concept diagrams to explain a generation method of excitation sample.

As been understood from FIG. 7A and FIG. 7B, in the case of j+m, since the pulse positions of the sub-excitation vectors of subcodebooks 61*a* and 62*a* are relatively near, a small value of the addition gain is calculated using the equation (1) described previously. Accordingly, the addition gain for subcodebooks 61*b* and 62*b* is small. Because of it, as illustrated in FIG. 7C, excitation vector addition section 68 obtains an excitation sample composed of a small number of pulses which reflects the characteristics of subcodebooks 61*a* and 62*a* respectively illustrated in FIG. 7A and FIG. 7B. This excitation sample is effective on voiced speech.

Further, as been understood from FIG. 7A and FIG. 7B, in the case of j+n, since the pulse positions of the sub-excitation vectors of subcodebooks 61*a* and 62*a* are relatively far, a large value of the addition gain is calculated using the equation (1) described previously. Accordingly, the addition gain for subcodebooks 61*b* and 62*b* is large. Because of it, as illustrated in FIG. 7F, excitation vector addition section 68 obtains an excitation sample with strong random characteristics with spread energy which reflects the characteristics of subcodebooks 61*b* and 62*b* respectively illustrated in FIG. 7D and FIG. 7E. This excitation sample is effective on unvoiced speech/background noise.

This embodiment describes about the case of using two codebooks (two channels). However, it is also preferable to apply the present invention to the case of using codebooks equal to or more than three (channels equal to or more than three). In this case, as a numerator of the equation in gain calculating section 63, i.e., equation (1), the minimum value among from intervals between two pulses or the averaged value of all pulse intervals is used. For example, in the case where the number of codebooks is three and the minimum pulse interval is used as a numerator of the equation (1), the calculation equation is given by the following equation (2);

$$g=\min(|P1-P2|,|P2-P3|,|P3-P1|)/L \qquad \text{equation (2)}$$

where g is an addition gain, P1, P2 and P3 are respective pulse positions in those three codebooks, and L is a vector length (subframe length). In addition, | | represents an absolute value.

As described above, according to this embodiment, a plurality of codebooks have two subcodebooks each having respective sub-excitation vectors of which characteristics are different, and the excitation vector is obtained by adding each sub-excitation vector, thereby making it possible to correspond to input signals with various characteristics.

In addition, since the gain to be multiplied by the sub-excitation vector is varied corresponding to the characteristics of the sub-excitation vectors, it is possible to reflect both characteristics of excitation vectors stored in two codebooks in the speech by a gain adjustment, thereby making it possible to effectively execute coding and decoding most suitable for the characteristics of the input signals with various characteristics.

Specifically, since one of two subcodebooks stores a plurality of sub-excitation vectors composed of a small number of pulses, and another subcodebook stores a plurality of sub-excitation vectors composed of a large number of pulses, it is possible to achieve fine sound qualities in voiced speech by the excitation sample with the characteristics of a small number of pulses, and perform excitation generation most suitable to the characteristics of input signals with various characteristics.

In addition, since gain calculating section calculates a gain using a distance of pulse positions of sub-excitation vectors composed of a small number of pulses, it is possible to achieve synthesized speeches with fine sound qualities in voiced speech by the small number of pulses of which distance is near, while achieve perceptually fine synthesized speeches in unvoiced speech/background noise by the large number of pulses with spread energy.

In the addition gain calculation described above, the processing is simplified by using a fixed value which is predetermined as an addition gain. In this case, it is not necessary to install gain calculating section 63. Even in this case, it is possible to achieve synthesized speeches matching the needs timely by varying the setting of the fixed value properly. For example, it is possible to achieve coding excellent for plosive speech such as low voice like male voice by setting the addition gain on a small scale, while to achieve coding excellent for random speeches such as background noise by setting the addition gain on a large scale.

In addition, it is also preferable to apply a method of calculating an addition gain adaptively using a level of input signal power, decoded LPC or adaptive codebook, besides the method of calculating the addition gain using pulse positions and another method of providing fixed coefficients to the addition gain. For example, it may be possible to achieve excellent coding adaptive for localized speech characteristics by preparing a function for determining voiced speech characteristics (such as vowel and standing wave) or unvoiced speech characteristics (such as background noise and unvoiced consonant) and setting a small gain in the case of voiced speech characteristics, while setting a large gain in the case of unvoiced speech characteristics.

Second Embodiment

This embodiment will describes about the case where a gain calculating section obtains decoded LPC from LPC analyzing section 42 and performs a voiced/unvoiced judgement using the obtained LPC.

Figure 8:
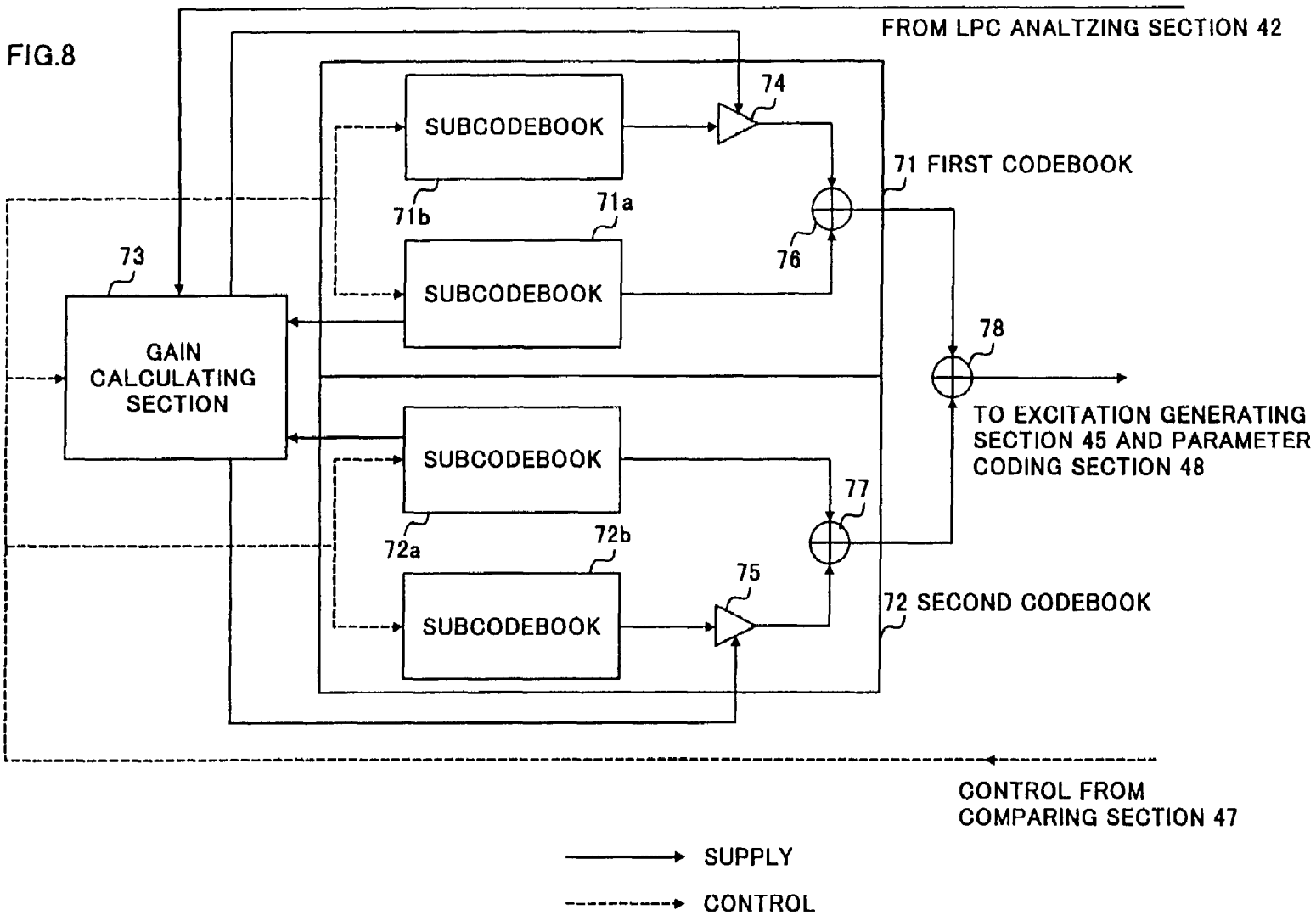
FIG. 8 is a block diagram illustrating a stochastic codebook in a speech coding apparatus/speech decoding apparatus according to the second embodiment of the present invention.

FIG. 8 is a block diagram illustrating a stochastic codebook in the speech coding apparatus/speech decoding apparatus according to the second embodiment of the present invention. The configurations of the speech coding apparatus and the speech decoding apparatus with the stochastic code book are the same as the first embodiment (FIG. 3 and FIG. 4).

The stochastic codebook has first codebook 71 and second codebook 72, and first codebook 71 and second codebook 72 respectively have two subcodebooks 71*a*, 71*b* and subcodebooks 72*a*, 72*b*. The stochastic codebook further has gain calculating section 73 which calculates a gain for outputs from subcodebooks 71*b* and 72*b* using pulse positions in subcodebooks 71*a* and 72*a*.

Subcodebooks 71*a* and 72*a* are mainly used in the case where a speech is a voiced sound (pulse positions are relatively near), and formed by storing a plurality of sub-excitation vectors composed of a single pulse. Subcodebook 71*b* and 72*b* are mainly used in the case where a speech is an unvoiced sound or background noise (pulse positions are relatively far), and formed by storing a plurality of sub-excitation vectors composed of a sequence with a plurality of pulses in which power is spread. The excitation samples are generated in the stochastic codebooks formed as described above.

In addition, subcodebooks 71*a* and 72*a* are formed by a method of arranging pulses algebraically, and subcodebooks 71*b* and 72*b* are formed by another method of dividing a vector length (subframe length) into some segment intervals and making a configuration so that a single pulse is always present at every segment interval (pulses are spread over a whole length)

These codebooks are formed in advance. In this embodiment, as illustrated in FIG. 8, the number of codebooks is set at two and each codebook has two subcodebooks. The number of codebooks and the number of subcodebooks are not limited.

FIG. 6A illustrates sub-excitation vectors stored in subcodebook 71*a* of first codebook 71. FIG. 6B illustrates sub-excitation vectors stored in subcodebook 71*b* of first codebook 71. Similarly, subcodebooks 72*a* and 72*b* of second codebook 72 respectively have sub-excitation vectors illustrated in FIG. 6A and FIG. 6B.

In addition, positions and polarities of pluses of sub-excitation vectors in subcodebooks 71*b* and 72*b* are formed using random numbers. According to the configuration described above, it is possible to form sub-excitation vectors in which power is uniformly spread over a whole vector length even though some fluctuations are present. FIG. 6B illustrates an example in the case where the number of segment intervals is four. In addition, in these two subcodebooks, respective sub-excitation vectors of the same index (number) are used at the same time.

The next description is given to explain speech coding using the stochastic codebooks with the above-mentioned configuration.

Gain calculating section 73 obtains decoded LPC from LPC analyzing section 42 and performs a voiced/unvoiced judgement using the obtained LPC. Specifically, gain calculating section 73 beforehand collects data corresponding to LPC, for example, obtained by converting the LPC into impulse response or LPC cepstrum, with respect to a lot of speech data, by relating to every mode, for example, voiced speech, unvoiced speech and background noise. Then the data are subjected to statistic processing and based on the result, a rule of judging, voiced, unvoiced and background noise is generated. As an example of the rule, it is general to use linear determination function and Bayes judgment. Then, based on the judgment result obtained according to the rule, weighting coefficient R is obtained by a regulation of the following equation (3);

$$R=L\text{:when judged as voiced speech}$$

$$R=L\times 0.5\text{:when judged as unvoiced speech/background noise} \qquad \text{equation (3)}$$

where R is a weighting coefficient, and L is a vector length (subframe length).

Gain calculating section 73 next receives an instruction of the number of excitation vector (index number) from comparing section 47 in the speech coding apparatus, and according to the instruction, fetches sub-excitation vectors of the designated number respectively from subcodebooks 71*a* and 72*a* with a small number of pulses. Gain calculating section 73 calculates an addition gain using pulse positions of the-fetched sub-excitation vectors. The calculation of the addition gain is executed according to the following equation (4);

$$g=|P1-P2|/R \qquad \text{equation (4)}$$

where g is an addition gain, P1 and P2 are respectively pulse positions in codebooks 71*a* and 72*a*, and R is a weighting coefficient. Further, | | represents an absolute value.

According to the above equations (3) and (4), the addition gain is smaller as the pulse positions are nearer, while larger as pulse positions are further, and has a lower limit of 0 and an upper limit of L/R. Accordingly, as the pulse positions are nearer, the gain for subcodebooks 71*b* and 72*b* is relatively smaller. As a result, an affect of subcodebooks 71*a* and 72*a* corresponding to voiced speech is larger. On the other hand, as the pulse positions are further, the gain for subcodebooks 71*b* and 72*b* is relatively larger. As a result, an affect of subcodebooks 71*b* and 72*b* corresponding to unvoiced speech and background noise is larger. Perceptually fine sounds are obtained by performing the gain calculation described above.

Further, excitation vector addition section 76 obtains a sub-excitation vector from subcodebook 61*a* with a small number of pulses by referring to the number of excitation vector provided from comparing section 47, and also obtains a sub-excitation vector, from subcodebook 71*b*, multiplied by the addition gain obtained at gain calculating section 73. Excitation vector addition section 76 then adds the obtained sub-excitation vectors to obtain an excitation vector. Similarly, excitation vector addition section 77 obtains a sub-excitation vector from subcodebook 72*a* with a small number of pulses by referring to the number of excitation vector provided from comparing section 47, and also obtains a sub-excitation vector, from subcodebook 72*b*, multiplied by the addition gain obtained at gain calculating section 73. Excitation vector addition section 77 then adds the obtained sub-excitation vectors to obtain an excitation vector.

The excitation vectors respectively obtained by adding the sub-excitation vector are provided to excitation vector addition section 68 to be added. According to the foregoing processing, an excitation sample (stochastic code vector) is obtained. The excitation sample is provided to excitation generating section 45 and parameter coding section 48.

On the other hand, a decoding side prepares the same adaptive codebook and stochastic codebook as those in the coder in advance, and based on respective index, LPC code, and gain code of each codebook transmitted from the transmission path, multiplies respective excitation sample by the gain to add.

Then the decoding side executes filtering on the added sample with the decoded LPC to decode the speech.

At this stage, it is necessary to provide the decoded LPC to the stochastic codebook in this embodiment, which differs from the first embodiment. Specifically, at this stage, parameter decoding section 52 provides the obtained LPC along with the sample number for the stochastic codebook to the stochastic codebook (which corresponds to that the signal line from parameter decoding section 52 to stochastic codebook 54 in FIG. 4 includes the signal line from "LPC analyzing section 42" and the control line indicative of "control from comparing section 47").

The excitation samples selected by the above algorithm are the same as the first embodiment and illustrated in FIG. 7A to FIG. 7F.

As described above, according to this embodiment, gain calculating section 73 performs the voiced/unvoiced judgement using the decoded LPC, and calculates the addition gain using weighting coefficient R obtained according to equation (3), resulting in a small gain at the time of voiced speech and a large gain at the time of unvoiced speech and background noise. The obtained excitation samples are thereby a smaller number of pulses in voiced speech and a large number of pulses containing more noises in unvoiced speech and background noise. Accordingly, it is possible to further improve the effect by adaptive pulse positions described above, thereby enabling synthesized speech with more excellent sound qualities to be achieved.

In addition, the speech coding in this embodiment also has the effect on transmission error. In the coding with a conventional voiced/unvoiced judgment, stochastic codebooks are switched generally by LPC. Because of it, when a transmission error introduces a wrong judgment, the decoding is sometimes executed with absolutely different excitation samples, resulting in a low transmission error resistance.

On the contrary, in the speech coding in this embodiment, if wrong LPC are used in the voiced/unvoiced judgment in decoding, only a value of addition gain varies a little, and the deterioration caused by the transmission error is little. Hence, according to this embodiment, it is possible to obtain synthesized speeches with excellent sound qualities without being affected by the transmission error of LPC code largely, while executing the adaptation by LPC.

This embodiment describes about the case of using two codebooks (two channels). However, it is also preferable to apply the present invention to the case of using codebooks equal to or more than three (channels equal to or more than three). In this case, as a numerator of the equation in gain calculating section 63, i.e., equation (4), the minimum value among from intervals between two pulses or the averaged value of all pulse intervals is used.

The first and second embodiments describe about the case of adjusting gains for outputs from subcodebooks 61*b*, 62*b*, 71*b* and 72*b*. However, it is also preferable to adjust outputs from subcodebooks 61*a*, 62*a*, 71*a* and 72*a* or to adjust outputs from all subcodebooks, under the condition that a gain for outputs from subcodebooks is adjusted so that an affect by excitation vectors with a small number of pulses is large when pulse positions are near, while an affect by excitation vectors with a large number of pulses is large when pulse positions are far.

Third Embodiment

This embodiment will describe about the case of switching an excitation vector to acquire from a subcodebook corresponding to a distance of pulse intervals.

Figure 9:
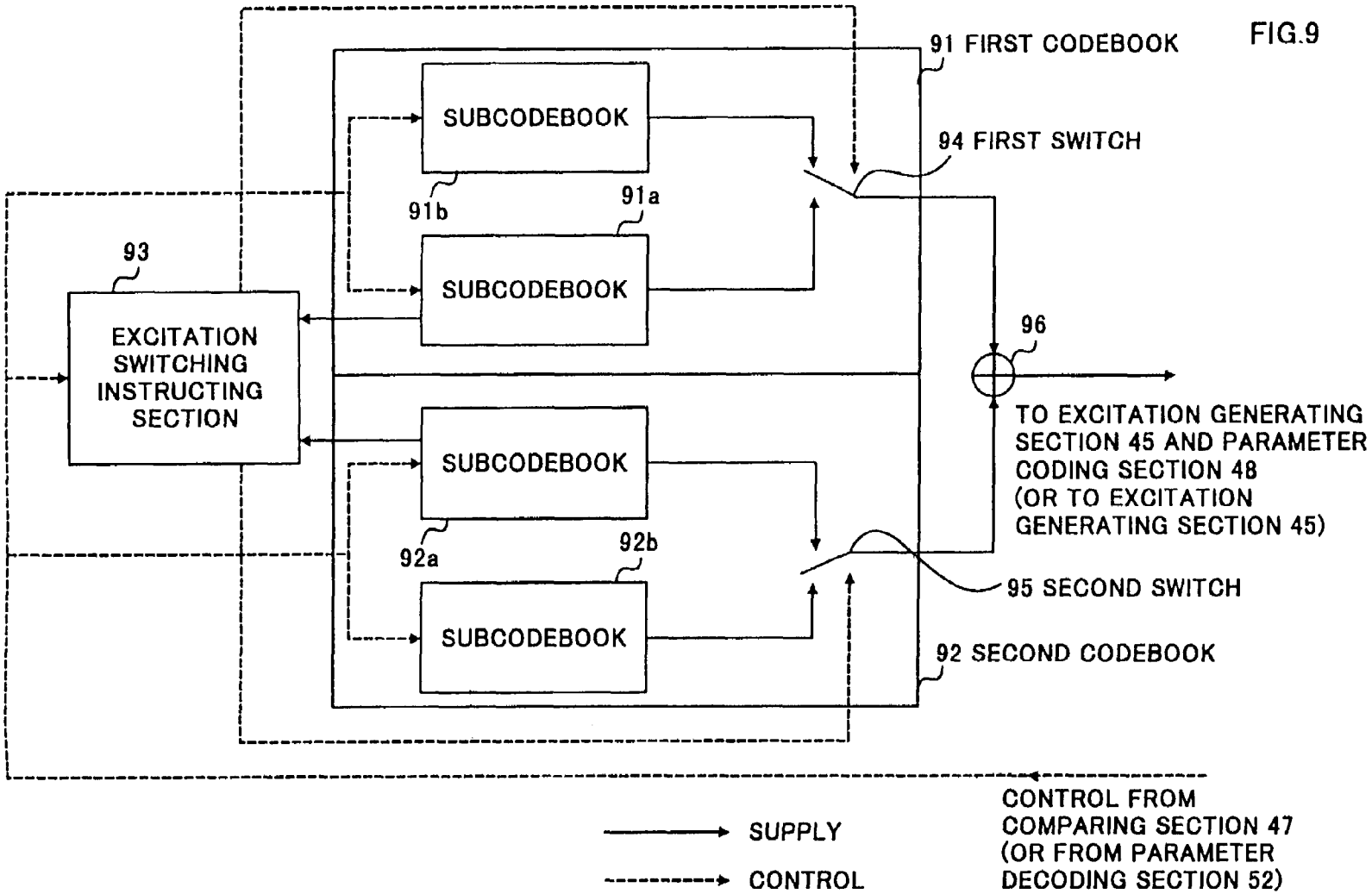
FIG. 9 is a block diagram illustrating a stochastic codebook in a speech coding apparatus/speech decoding apparatus according to the third embodiment of the present invention.

FIG. 9 is a block diagram illustrating a stochastic codebook in the speech coding apparatus/speech decoding apparatus according to the third embodiment of the present invention. The configurations of the speech coding apparatus and the speech decoding apparatus with the stochastic code book are the same as the first embodiment (FIG. 3 and FIG. 4).

The stochastic codebook has first codebook 91 and second codebook 92, and first codebook 91 and second codebook 92 respectively have two subcodebooks 91*a*, 91*b* and subcodebooks 92*a*, 92*b*. The stochastic codebook further has excitation switching instructing section 93 which executes switching between outputs from subcodebooks 91*b* and 92*b* corresponding to a pulse position in subcodebooks 91*a* and 92*a*.

Subcodebooks 91*a* and 92*a* are mainly used in the case where a speech is a voiced sound (pulse positions are relatively near), and formed by storing a plurality of sub-excitation vectors composed of a single pulse. Subcodebook 91*b* and 92*b* are mainly used in the case where a speech is an unvoiced sound or background noise (pulse positions are relatively far), and formed by storing a plurality of sub-excitation vectors composed of a sequence with a plurality of pulses in which power is spread. The excitation samples are generated in the stochastic codebooks formed as described above.

In addition, subcodebooks 91*a* and 92*a* are formed by a method of arranging pulses algebraically, and subcodebooks 91*b* and 92*b* are formed by another method of dividing a vector length (subframe length) into some segment intervals and making a configuration so that a single pulse is always present at every segment interval (pulses are spread over a whole length).

These codebooks are formed in advance. In this embodiment, as illustrated in FIG. 9, the number of codebooks is set at two and each codebook has two subcodebooks. The number of codebooks and the number of subcodebooks are not limited.

Figure 10A:
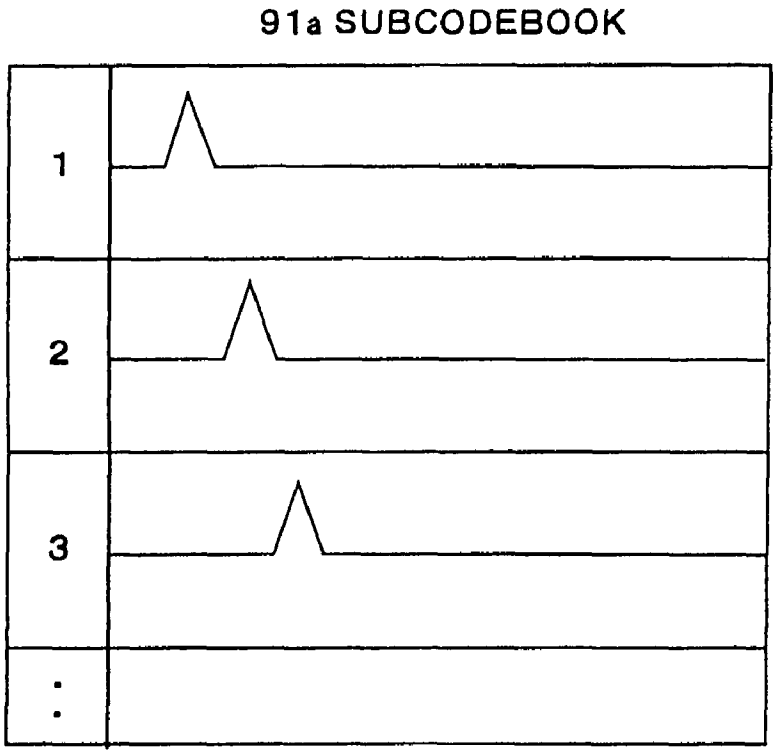
FIG. 10A and FIG. 10B are concept diagrams of sub-excitation vectors stored in subcodebooks in the stochastic codebook.
Figure 10B:
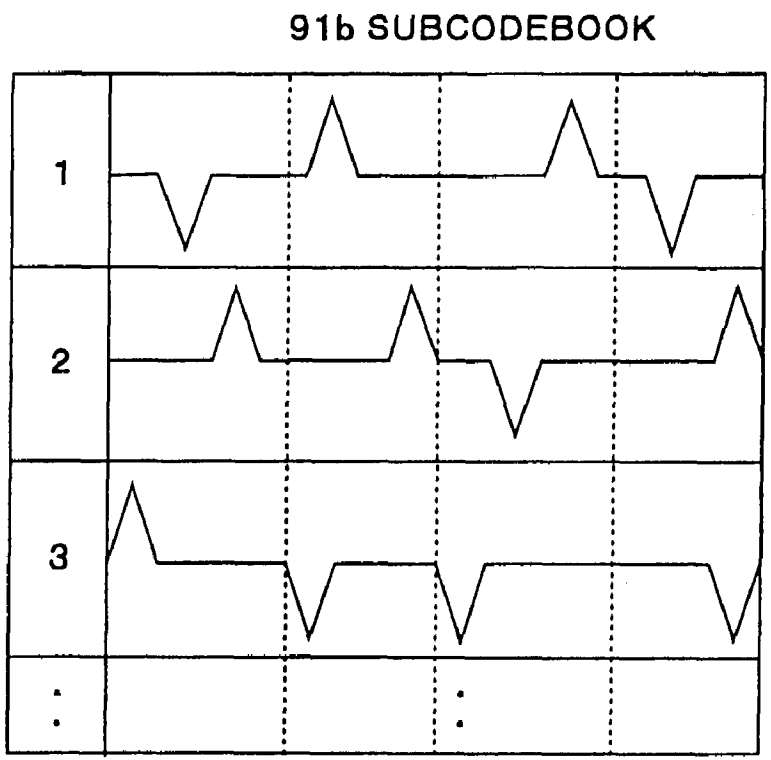

FIG. 10A illustrates sub-excitation vectors stored in subcodebook 91*a* of first codebook 91. FIG. 10B illustrates sub-excitation vectors stored in subcodebook 91*b* of first codebook 91. Similarly, subcodebooks 92*a* and 92*b* of second codebook 92 respectively have sub-excitation vectors illustrated-in FIG. 10A and FIG. 10B.

In addition, positions and polarities of pluses of sub-excitation vectors in subcodebooks 91*b* and 92*b* are formed using random numbers. According to the configuration described above, it is possible to form sub-excitation vectors in which power is uniformly spread over a whole vector length even though some fluctuations are present. FIG. 10B illustrates an example in the case where the number of segment intervals is four. In addition, in these two subcodebooks, respective sub-excitation vectors of the same index (number) are not used at the same time.

The next description is given to explain speech coding using the stochastic codebooks with the above-mentioned configuration.

Excitation switching instructing section 93 calculates the excitation vector number (index) according to a code from comparing section 47 in the speech coding section. The code provided from comparing section 47 corresponds to the excitation vector number, and therefore the excitation vector number is determined by the code. Excitation switching instructing section 93 fetches sub-excitation vectors with a small number of pulses corresponding to the determined excitation vector number from subcodebooks 91*a* and 92*a*. Further, excitation switching instructing section 93 executes a judgment described as below, using pulse positions of the fetched sub-excitation vectors;

$$|P1-P2|<Q\text{:using subcodebooks 91}a\text{ and 92}a$$

$$|P1-P2|\geqq Q\text{:using subcodebooks 91}b\text{ and 92}b,$$

where P1 and P2 are respectively pulse positions in subcodebooks 91*a* and 92*a*, Q is a constant and | | represents an absolute value.

In the above judgment, excitation vectors with a small number of pulses are selected when pulse positions are near, while excitation vectors with a large number of pulses are selected when pulse positions are far. Performing the judgment and selection as described above enables perceptually fine sounds to be achieved. The constant Q is predetermined. It is possible to vary the ratio of the excitation with a small number of pulses and the excitation with a large number of pulses by varying the constant Q.

Excitation switching instructing section 93 fetches excitation vectors from subcodebooks 91*a* and 92*a* or subcodebooks 91*b* and 92*b* in codebooks 91 or 92 according to the switching information (switching signal) and the code of excitation (sample number). The switching is executed at first and second switches 94 and 95.

The obtained excitation vectors are provided to excitation vector addition section 96 to be added. The excitation sample (stochastic code vector) is thus obtained. The excitation sample is provided to excitation generating section 45 and parameter coding section 48. In addition, at a decoding side, the excitation sample is provided to excitation generating section 55.

An example of excitation samples selected by the above-mentioned algorithm will be described next using FIG. 11A to FIG. 11F. Assume that an index of first codebook 91 is j, and an index of second codebook 92 is m or n.

Figures 11A, 11B, 11C, 11D, 11E, 11F:
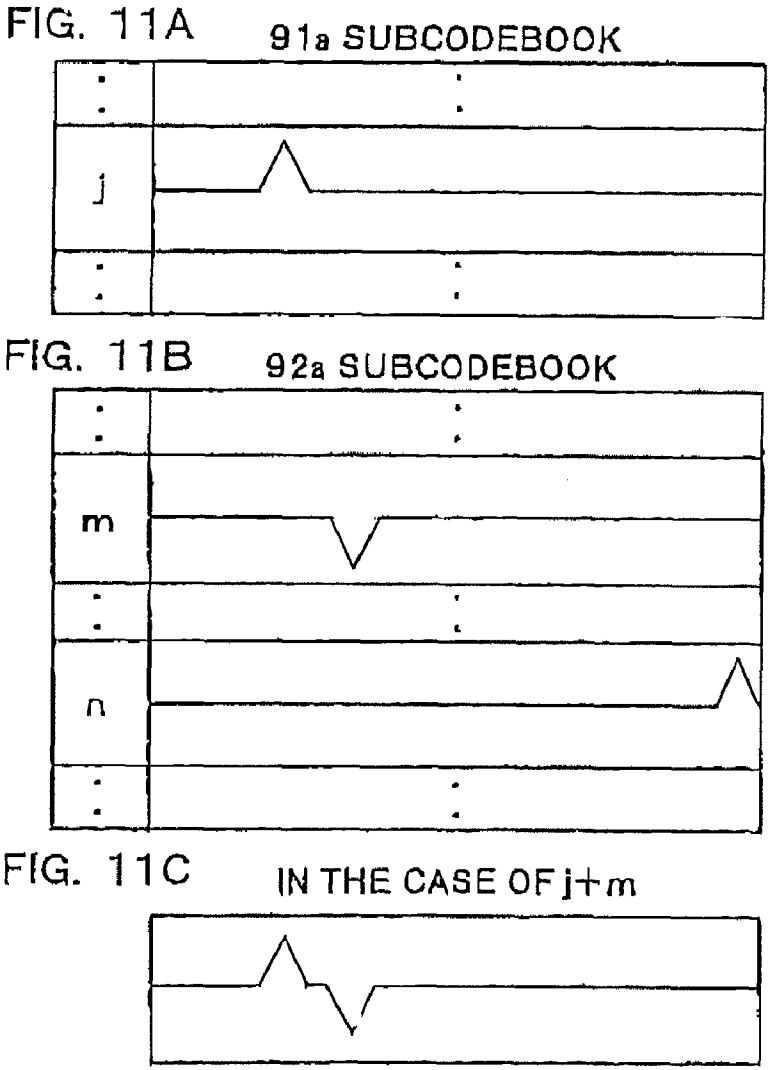
FIGS. 11A to 11F are concept diagrams to explain a generation method of excitation sample.

As been understood from FIG. 11A and FIG. 11B, in the case if j+m, since the pulse positions of the sub-excitation vectors of subcodebooks 91*a* and 92*a* are relatively near, excitation switching instructing section 93 selects sub-excitation vectors with a small number of pulses according to the above judgment. Then, excitation vector addition section 96 adds two sub-excitation vectors selected respectively from subcodebooks 91*a* and 92*a* illustrated in FIG. 11A and FIG. 11B and obtains an excitation sample with strong pulse characteristics as illustrated in FIG. 11C. This excitation sample is effective on voiced speech.

Further, as been understood from FIG. 11A and FIG. 11B, in the case of j+n, since the pulse positions of the sub-excitation vectors of subcodebooks 91*a* and 92*a* are relatively far, excitation switching instructing section 93 selects sub-excitation vectors with a large number of pulses according to the above judgment. Then, excitation vector addition section 96 adds two sub-excitation vectors selected respectively from subcodebooks 91*b* and 92*b* illustrated in FIG. 11D and FIG. 11E. and obtains an excitation sample with strong random characteristics with spread energy as illustrated in FIG. 11F. This excitation sample is effective on unvoiced speech/background noise.

As described above, according to this embodiment, an excitation sample is generated by switching excitation vectors in two subcodebooks which a plurality of codebooks each have to obtain, and using excitation vectors obtained from either of subcodebooks in each codebook. It is thus possible to correspond to input signals with various characteristics by a fewer amount of computations.

Since one of two subcodebooks stores a plurality of excitation vectors with a small number of pulses while another one stores a plurality of excitation vectors with a large number of pulses in which power is spread, it is possible to use the excitation sample with a small number of pulses for voiced speech while use another excitation sample with a large number of pluses for unvoiced speech/background noise. It is thereby possible to obtain synthesized speeches with excellent sound qualities, and also to obtain excellent performances for input signals with various properties.

Further, since the excitation switching instructing section switches excitation vectors to acquire from a subcodebook corresponding to a distance between pulse positions, it is possible to achieve synthesized speeches with fine sound qualities in voiced speech by a small number of pulses of which distances are near, wile achieve perceptually fine synthesized speeches in unvoiced speech and background noise by a large number of pulses in which power is spread. Furthermore, since the excitation switching instructing section acquires excitation vectors from a subcodebook while switching, for example, it is not necessary to calculate a gain and multiple the gain by a vector in an stochastic codebook. Accordingly, in the speech coding according to this embodiment, a computation amount is much less than the case of calculating the gain.

That is, since the above-mentioned switching is executed based on a relative distance between pulse positions of sub-excitation vectors composed of a small number of pulses, it is possible to achieve fine synthesized speeches in voiced speech by excitation samples with a small number of pulses of which distance are near, while achieve perceptually fine synthesized speeches in unvoiced speech/background noise by excitation samples with a large number of pulses with spread power.

This embodiment describes about the case of using two codebooks (two channels). However, it is also preferable to apply the present invention to the case of using codebooks equal to or more than three (channels equal to or more than three). In this case, as a judgment basis in excitation switching instructing section 93, the minimum value among from intervals between two pulses or the averaged value of all pulse intervals is used. For example, in the case of using three codebooks and the minimum value among from intervals between two pulses, the judgment basis is as follows;

$$\min(|P1-P2|,|P2-P3|,|P3-P1|)<Q\text{:using subcodebooks a}$$

$$\min(|P1-P2|,|P2-P3|,|P3-P1|)\geqq Q\text{:—using subcodebooks b}$$

where P1, P2 and P3 are respectively pulse positions in respective codebooks, Q is a weighting coefficient, and | | represents an absolute value.

In the speech coding/decoding according to this embodiment, it may be possible to combine voiced/unvoiced judgment algorithm in the same way as the second embodiment. In other words, at a coding side, the excitation switching instructing section obtains decoded LPC from the LPC analyzing section and executes the voiced/unvoiced judgment using the LPC, and at a decoding side, the decoded LPC is provided to the stochastic codebook. According to the aforementioned processing, it is possible to improve the effect by adapted pulse positions and achieve synthesized speeches with more excellent sound qualities.

The above constitution is achieved by providing voiced/unvoiced judgment sections separately at a coding side and a decoding side and corresponding to the judgment result, making Q variable as a threshold value for the judgment of excitation switching instructing section. In this case, Q is set at a large scale in the case of voiced speech while Q is set at a low scale in the case of unvoiced speech in order to enable varying the ratio of the number of excitations with a small number of pulses and the number of excitations with a large number of pulses corresponding to localized characteristics of speeches.

In addition, in the case where the voiced/unvoiced judgment is executed by backward (using other decoded parameters without transmitting as code), there is a possibility that a wrong judgment occurs by transmission error. According to the coding/decoding in this embodiment, since the voiced/unvoiced judgment is executed only by varying threshold Q, a wrong judgment affects only a difference of threshold Q between in the cases of voiced speech and unvoiced speech. Accordingly, the affects caused by the wrong judgment is very small.

In addition, it may be possible to use a level of input signal power, decoded LPC and a method of calculating Q adaptively using an adaptive codebook. For example, prepare in advance a function for determining voiced characteristics (such as vowel and standing wave) or unvoiced characteristics (such as background noise and unvoiced consonant) using the above parameters, and set Q at a large scale at the time of the voiced characteristics, while set Q at a low scale at the time of the unvoiced characteristics. According to the aforementioned processing, it is possible to use an excitation sample composed of a small number of pulses in a voiced characteristics interval and another excitation sample composed of a large number of pulses in a unvoiced characteristics interval, thereby making it possible to obtain excellent coding performance adaptive for speech localized characteristics.

Figure 12:
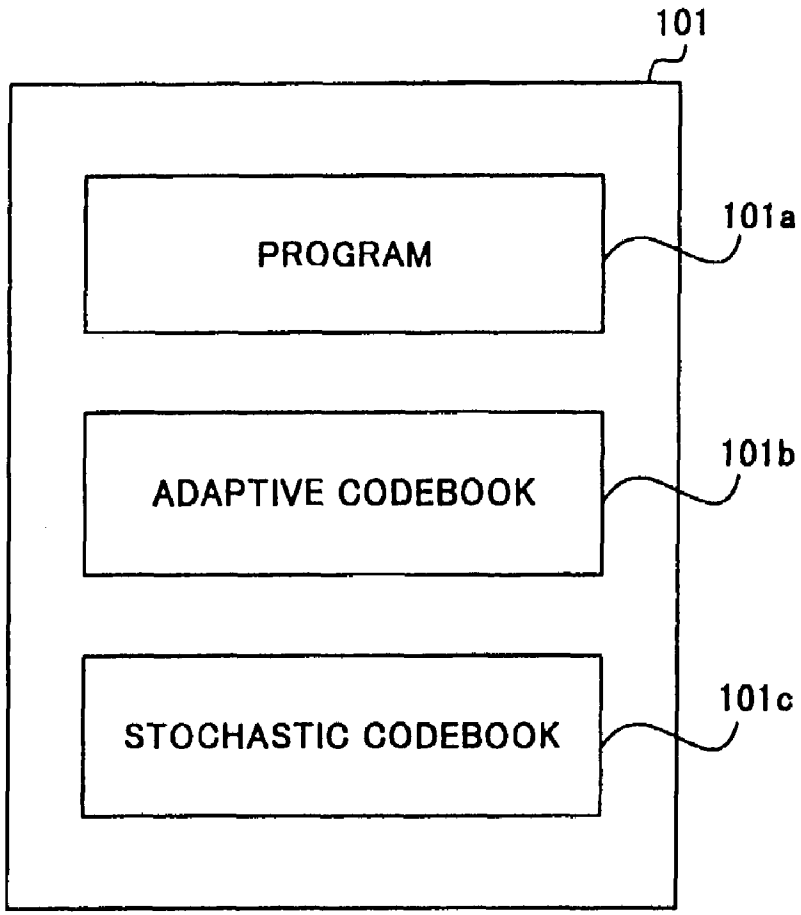
FIG. 12 is a diagram illustrating a schematic configuration of a data medium storing a program for the speech coding apparatus/speech decoding apparatus of the present invention.

In addition, the speech coding/decoding according to the first to third embodiments are described as speech coding apparatus/speech decoding apparatus, however it may be possible to construct the speech coding/decoding as software. For example, it may be possible to store the program for the above-described speech coding/decoding in a ROM and operate by instructions of a CPU according to the program. Further, as illustrated in FIG. 12, it may be possible to store program 101*a*, adaptive codebook 101*b* and algebraic codebook 101*c* in recording medium 101 which is readable by computer, write program 101*a* of recording medium 101, adaptive codebook 101*b* and stochastic codebook 101*c* in a RAM of a computer and operate according to the program. These cases also achieve the same functions and effects as the first to third embodiments described above.

The first to third embodiments describe the case where the number of pulses is one as an excitation vector with a small number of pulses, it may be possible to use an excitation vector in which the number of pulses is equal to or more than two as an excitation vector with a small number of pulses. In this case, it is preferable to apply an interval of pulses whose positions are the nearest among from a plurality of pulses as the near-far judgment of pulse positions.

The first to third embodiments describe about the case of adapting the present invention to speech coding apparatus/speech decoding apparatus in the CELP system, however the present invention is applicable to any speech coding/decoding using "codebook" because the feature of the present invention is in an stochastic codebook. For example, the present invention is applicable to "RPE-LPT" that is a standard full rate codec by GSM and "MP-MLQ" that is an international standard codec "G.723.1" by ITU-T.

This application is based on the Japanese Patent Applications No. HEI10-160119 filed on Jun. 9, 1998 and No. HEI10-258271 filed on Sep. 11, 1998, entire contents of which are expressly incorporated by reference herein.

INDUSTRIAL APPLICABILITY

The speech coding apparatus and speech decoding apparatus according to the present invention are applicable to portable telephones and digital communications using speech coding algorithm at low bit rates.

This application is based on the Japanese Patent Applications No. HEI10-160119 filed on Jun. 9, 1998 and No. HEI10-258271 filed on Sep. 11, 1998, entire content of which is expressly incorporated by reference herein.

The invention claimed is:

1. An apparatus for performing speech coding in a CELP system, comprising:

an adaptive codebook that stores previously synthesized excitation signals;

a stochastic codebook that stores a plurality of excitation vectors;

a synthesized speech obtainer that obtains synthesized speech from excitation information acquired from the adaptive codebook and the stochastic codebook and linear predictive coding coefficients obtained by performing linear predictive coding analysis on an input speech signal;

a gain information obtainer that obtains gain information for the synthesized speech using a relation of the synthesized speech and the input speech signal; and a transmitter that transmits the linear predictive coding coefficients, the excitation information and the gain information, wherein the stochastic codebook comprises:

a first subcodebook that stores first sub-excitation vectors comprising pulses and outputs one of the first sub-excitation vectors corresponding to an inputted index;

a second subcodebook that stores second sub-excitation vectors comprising a larger number of pulses than the first sub-excitation vectors, and outputs one of the second sub-excitation vectors corresponding to the inputted index;

a control section that controls an addition gain based on information about pulses of the first sub-excitation vector outputted from the first subcodebook, the second sub-excitation vector outputted from the second subcodebook being multiplied by the addition gain; and a computation section that adds the second sub-excitation vector multiplied by the addition gain and the first excitation vector outputted from the first subcodebook, and obtains an excitation vector.

2. The apparatus of claim 1, wherein the control section controls the addition gain based on a distance between the pulses of the first sub-excitation vector outputted from the first subcodebook.

3. The apparatus of claim 1, wherein said control section reduces the addition gain when the distance between pulses of the first sub-excitation vector outputted from the first subcodebook decreases, and increases the addition gain when the distance between a pulse of the first excitation vector outputted from the first subcodebook increases.

4. The apparatus of claim 1, wherein the control section calculates the addition gain according to a following equation 1, $$g=|P1-P2|/L \quad (1),$$

wherein g is the addition gain, P1 and P2 are pulse positions of the first sub-excitation vector of the first subcodebook, and L is a vector length.

5. The apparatus of claim 1, further comprising a judgment section that performs voiced/unvoiced judgment using the linear predictive coding coefficients, wherein the control section controls the addition gain based on a result of the voiced/unvoiced judgment.

6. The apparatus of claim 5, wherein the control section comprises the judgment section.

7. The apparatus of claim 5, wherein the control section calculates the addition gain according to a following equation 2, $$g=|P1-P2|/R \quad (2),$$

wherein g is the addition gain, P1 and P2 are pulse positions of the first sub-excitation vector of the first subcodebook, R is a weighting coefficient, R being a vector length L when a result of the voiced/unvoiced judgment indicates a voiced speech, and being L×0.5 when the result of the voiced/unvoiced judgment indicates an unvoiced speech.

8. An apparatus for performing speech coding in a CELP system, comprising:

an adaptive codebook that stores previously synthesized excitation signals;

a stochastic codebook that stores a plurality of excitation vectors;

a synthesized speech obtainer that obtains synthesized speech from excitation information acquired from the adaptive codebook and the stochastic codebook and linear predictive coding coefficients obtained by performing linear predictive coding analysis on an input speech signal;

a gain information obtainer that obtains gain information for the synthesized speech using a relation of the synthesized speech and the input speech signal; and a transmitter that transmits the linear predictive coding coefficients, the excitation information and the gain information, wherein the stochastic codebook comprises:

a first subcodebook that stores first sub-excitation vectors comprising pulses and outputs one of the first sub-excitation vectors corresponding to an inputted index;

a second subcodebook that stores second sub-excitation vectors comprising a larger number of pulses than the first sub-excitation vectors, and outputs one of the second sub-excitation vectors corresponding to the inputted index;

an instruction section that selects one of the first sub-excitation vector outputted from the first subcodebook and the second sub-excitation vector outputted from the second subcodebook, based on information about pulses of the first sub-excitation vector outputted from the first subcodebook; and a switching section that switches between the first sub-excitation vector outputted from the first subcodebook and the second sub-excitation vector outputted from the second subcodebook following the selection by said instruction section.

9. The apparatus of claim 8, further comprising a judgment section that performs voiced/unvoiced judgment using the linear predictive coding coefficients, wherein the instruction section instructs one of the first sub-excitation vector outputted from the first subcodebook and the second sub-excitation vector outputted from the second subcodebook, based on a result of the voiced/unvoiced judgment.

10. An apparatus for performing speech decoding in a CELP system, the apparatus comprising:

an adaptive codebook that stores previously synthesized excitation signals;

a stochastic codebook that stores a plurality of excitation vectors;

a receiver that receives linear predictive coding coefficients, excitation information and gain information;

a speech decoder that decodes speech using the linear predictive coding coefficients and a multiplication result of the excitation information and the gain information, wherein the stochastic codebook comprises:

a first subcodebook that stores first sub-excitation vectors comprising pulses and outputs one of the first sub-excitation vectors corresponding to an inputted index;

a second subcodebook that stores second sub-excitation vectors comprising a larger number of pulses than the first sub-excitation vectors, and outputs one of the second sub-excitation vectors corresponding to the inputted index;

a control section that controls an addition gain based on information about pulses of the first sub-excitation vector outputted from the first subeodebook, the second sub-excitation vector outputted from the second subcodebook being multiplied by the addition gain; and a computation section that adds the second sub-excitation vector multiplied by the addition gain and the first excitation vector outputted from the first subcodebook, and obtains an excitation vector.

11. The apparatus of claim 10, further comprising a judgment section that performs voiced/unvoiced judgment using the linear predictive coding coefficients, wherein the control section controls the addition gain based on a result of the voiced/unvoiced judgment.

12. A method for performing speech coding in a CELP system, comprising:

selecting one of previously synthesized excitation signals stored in an adaptive codebook;

selecting one of a plurality of excitation vectors stored in a stochastic codebook;

obtaining synthesized speech from excitation information acquired from the adaptive codebook and the stochastic codebook and linear predictive coding coefficients obtained by performing linear predictive coding analysis on an input speech signal;

obtaining gain information for the synthesized speech using a relation of the synthesized speech and the input speech signal; and transmitting the linear predictive coding coefficients, the excitation information and the gain information, wherein the selection of the one of the plurality of excitation vectors stored in the stochastic codebook comprises:

outputting, from a first subcodebook that stores first sub-excitation vectors comprising pulses, one of the first sub-excitation vectors corresponding to an inputted index;

outputting, from a second subcodebook that stores second sub-excitation vectors comprising a larger number of pulses than the first sub-excitation vectors, one of the second sub-excitation vectors corresponding to the inputted index;

controlling an addition gain based on information about pulses of the first sub-excitation vector outputted from the first subcodebook, the second sub-excitation vector outputted from the second subcodebook being multiplied by the addition gain; and adding the second sub-excitation vector multiplied by the addition gain and the first excitation vector outputted from the first subcodebook and obtaining an excitation vector.

13. The method of claim 12, further comprising performing voiced/unvoiced judgment using the linear predictive coding coefficients, wherein the addition gain is controlled based on a result of the voiced/unvoiced judgment.

14. A method for performing speech coding in a CELP system, comprising:

selecting one of previously synthesized excitation signals stored in an adaptive codebook;

selecting one of a plurality of excitation vectors stored in a stochastic codebook;

obtaining synthesized speech from excitation information acquired from the adaptive codebook and the stochastic codebook and linear predictive coding coefficients obtained by performing linear predictive coding analysis on an input speech signal;

obtaining gain information for the synthesized speech using a relation of the synthesized speech and the input speech signal; and transmitting the linear predictive coding coefficients, the excitation information and the gain information, wherein the selection of the one of the plurality of excitation vectors stored in the stochastic codebook comprises:

outputting, from a first subcodebook that stores first sub-excitation vectors comprising pulses, one of the first sub-excitation vectors corresponding to an inputted index;

outputting, from a second subcodebook that stores second sub-excitation vectors comprising a larger number of pulses than the first sub-excitation vectors, one of the second sub-excitation vectors corresponding to the inputted index;

selecting one of the first sub-excitation vector outputted from the first subcodebook and the second sub-excitation vector outputted from the second subcodebook, based on information about pulses of the first sub-excitation vector outputted from the first subcodebook; and switching to one of the first sub-excitation vector outputted from the first subcodebook and the second sub-excitation vector outputted from the second subcodebook, following the selection.

15. The method of claim 14, further comprising performing voiced/unvoiced judgment using the linear predictive coding coefficients, wherein the one of the first sub-excitation vector outputted from the first subcodebook and the second sub-excitation vector outputted from the second subcodebook is based on a result of the voiced/unvoiced judgment.

16. A computer-readable medium which stores a program for performing speech coding in a CELP system, comprising:

an adaptive codebook that stores previously synthesized excitation signals;

a stochastic codebook that stores a plurality of excitation vectors;

a synthesized speech obtaining code segment for obtaining synthesized speech from excitation information acquired from the adaptive codebook and the stochastic codebook, and linear predictive coding coefficients obtained by performing linear predictive coding analysis on an input speech signal;

a gain information obtaining code segment for obtaining gain information for the synthesized speech using a relation of the synthesized speech and the input speech signal; and a transmitting code segment for transmitting the linear predictive coding coefficients, the excitation information and the gain information, wherein the stochastic codebook comprises:

a first subcodebook that stores first sub-excitation vectors comprising pulses and outputs one of the first sub-excitation vectors corresponding to an inputted index;

a second subcodebook that stores second sub-excitation vectors comprising a larger number of pulses than the first sub-excitation vectors and outputs one of the second sub-excitation vectors corresponding to the inputted index;

a controlling code segment for controlling an addition gain based on information about pulses of the first sub-excitation vector outputted from the first subcodebook, the second sub-excitation vector outputted from the second subcodebook being multiplied by the addition gain; and a computing code segment for adding the second sub-excitation vector multiplied by the addition gain and the first excitation vector outputted from the first subcodebook, and obtaining an excitation vector.

* * * * *

UNITED STATES PATENT AND TRADEMARK OFFICE

CERTIFICATE OF CORRECTION

PATENT NO. : 7,398,206 B2
APPLICATION NO. : 11/429944
DATED : July 8, 2008
INVENTOR(S) : T. Morii et al.

It is certified that error appears in the above-identified patent and that said Letters Patent is hereby corrected as shown below:

On the cover of the printed patent, at Item (63), Related U.S. Application, "Jan. 21, 2000" should be -- Jun. 8, 1999 --.

At column 19, line 22 (claim 10, line 24) of the printed patent, "subeodebook" should be -- subcodebook --.

Signed and Sealed this

Tenth Day of February, 2009

JOHN DOLL
*Acting Director of the United States Patent and Trademark Office*